US007384325B2

(12) United States Patent
Kelly et al.

(10) Patent No.: US 7,384,325 B2
(45) Date of Patent: Jun. 10, 2008

(54) FEATURE-ALTERING TOY

(75) Inventors: Emily Kelly, Torrance, CA (US); Tara McGrath, Hermosa Beach, CA (US); Bryan Cheng, Kowloon (HK); Jon C. Marine, Fullerton, CA (US)

(73) Assignee: Mattel, Inc., El Segundo, CA (US)

( * ) Notice: Subject to any disclaimer, the term of this patent is extended or adjusted under 35 U.S.C. 154(b) by 658 days.

(21) Appl. No.: 10/641,791

(22) Filed: Aug. 15, 2003

(65) Prior Publication Data

US 2004/0127140 A1 Jul. 1, 2004

Related U.S. Application Data

(60) Provisional application No. 60/404,188, filed on Aug. 15, 2002.

(51) Int. Cl.
*A63H 1/06* (2006.01)

(52) U.S. Cl. ..... 446/268; 446/320; 446/319

(58) Field of Classification Search ..... 446/268, 446/319, 297, 298, 299–305, 320–321, 337, 446/175, 475, 489, 484, 97, 98, 470, 471, 446/454

See application file for complete search history.

(56) References Cited

U.S. PATENT DOCUMENTS 2,709,220 A * 5/1955 Spector ..... 52/121
2,741,870 A 4/1956 Lang
2,789,393 A 4/1957 Cooke
3,253,799 A * 5/1966 Till ..... 242/390.3
3,535,818 A 10/1970 Pajak
3,670,451 A * 6/1972 Groves et al. ..... 446/319
3,691,679 A 9/1972 Kersten
3,694,957 A 10/1972 Houghton
3,698,134 A 10/1972 Amici et al.
3,808,736 A 5/1974 Terzian et al.
3,812,613 A 5/1974 Glass et al.
3,867,786 A * 2/1975 Greenblatt ..... 446/130
4,170,085 A 10/1979 Luke
4,246,722 A * 1/1981 Sapkus et al. ..... 446/320
4,259,807 A 4/1981 Siverstein
4,609,356 A * 9/1986 Gilden et al. ..... 434/259
4,622,021 A 11/1986 Darrigo (Continued)

FOREIGN PATENT DOCUMENTS

EP 537924 A1 * 4/1993

(Continued)

*Primary Examiner*—Monica Carter
*Assistant Examiner*—J Williams
(74) *Attorney, Agent, or Firm*—Kolisch Hartwell, P.C.

(57) ABSTRACT

One example of a toy system includes a first body, at least one accessory having an activation feature, at least one mechanism adapted to alter the first body, and a first sensor adapted to sense the activation feature and to activate selectively the at least one mechanism when the activation feature is sensed. The body may include first and second body elements that are moveable relative to each other, a drive element, and a sensor mounted relative to the body and adapted to be activated by a user. The second body element may also have a characteristic that is changeable. A first mechanism may have a plurality of operative states, and a function may be controlled based on the operating state.

13 Claims, 11 Drawing Sheets

U.S. PATENT DOCUMENTS 4,682,968 A * 7/1987 Droller et al. ..... 446/268
4,801,286 A 1/1989 Orenstein et al.
4,828,528 A 5/1989 Chatkis
4,917,647 A 4/1990 Wetherell et al.
5,029,214 A 7/1991 Hollander
5,037,345 A * 8/1991 Nakayama ..... 446/297
5,067,924 A 11/1991 Munter
5,073,140 A * 12/1991 Lebensfeld et al. ..... 446/297
5,087,219 A * 2/1992 Price ..... 446/336
5,116,277 A 5/1992 Kelley
5,125,865 A 6/1992 Orenstein et al.
5,129,853 A 7/1992 Bowling
5,290,198 A * 3/1994 Nakayama ..... 446/297
5,376,038 A 12/1994 Arad et al.
5,395,274 A * 3/1995 Myers ..... 446/16
5,415,580 A 5/1995 Ferri
5,449,103 A * 9/1995 Tilley ..... 224/244
5,507,678 A 4/1996 Chiang
5,607,336 A * 3/1997 Lebensfeld et al. ..... 446/297
5,951,363 A * 9/1999 Uetake ..... 446/470
6,016,038 A 1/2000 Mueller et al.
6,048,209 A 4/2000 Bailey
6,083,104 A * 7/2000 Choi ..... 463/6
6,135,847 A 10/2000 Coates
6,139,397 A 10/2000 Blau et al.
6,149,490 A 11/2000 Hampton et al.
6,150,774 A 11/2000 Mueller et al.
6,200,186 B1 * 3/2001 Coleman et al. ..... 446/73
6,244,926 B1 6/2001 George et al.
6,257,948 B1 * 7/2001 Silva ..... 446/100
6,293,866 B1 9/2001 Walker et al.
6,413,142 B1 7/2002 Weastler
6,447,361 B1 * 9/2002 Akiyama ..... 446/226
6,471,565 B2 * 10/2002 Simeray ..... 446/298
6,502,657 B2 * 1/2003 Kerrebrock et al. ..... 180/218
6,554,679 B1 * 4/2003 Shackelford et al. ..... 446/268
6,609,943 B1 * 8/2003 Chan ..... 446/297
6,641,455 B2 * 11/2003 Chan ..... 446/297
6,644,843 B2 * 11/2003 Chin-Cheng ..... 362/97
6,672,934 B2 * 1/2004 Hornsby et al. ..... 446/300
6,719,604 B2 * 4/2004 Chan ..... 446/297
6,800,014 B2 * 10/2004 Dominici et al. ..... 446/320
2001/0041495 A1 * 11/2001 Chan ..... 446/268
2003/0220044 A1 * 11/2003 Andrews et al. ..... 446/268

FOREIGN PATENT DOCUMENTS

FR 1369752 7/1964
FR 2411618 7/1979
FR 2508812 1/1983
JP 06154427 A * 6/1994
KR 2001028979 A * 4/2001
WO WO0209834 A2 2/2002

* cited by examiner

FEATURE-ALTERING TOY

CROSS-REFERENCE TO RELATED APPLICATION

This application claims the benefit of and priority under 35 U.S.C. 119(e) to U.S. Provisional Patent Application No. 60/404,188 entitled "Growing and Maturing Doll," filed Aug. 15, 2002, the disclosure of which is herein incorporated by reference.

BACKGROUND

The present disclosure relates generally to a toy with a body-altering feature, such as a doll that includes one or more telescoping body sections, and/or electronics that modify speech or other simulated behavior, for example, to simulate physical and/or emotional changes in the doll, or for other purposes.

In recent years animation in children's toys has become very popular. Animated toys include a system for generating motion, typically driven by small rotating motors that connect to gears, pulleys or levers. Some animation systems also include electronics for controlling the animation, and for controlling speech. Examples of such toys, including those in which the animation or controlled speech simulates growing or maturation of the doll, are disclosed in U.S. Pat. Nos. 2,741,870; 2,789,393; 3,535,818; 3,670,451; 3,691,679; 3,694,957; 3,698,134; 3,812,613; 4,170,085; 4,246,722; 4,259,807; 4,622,021; 4,801,286; 4,828,528; 5,029,214; 5,067,924; 5,116,277; 5,125,865; 5,129,853; 5,376,038; 5,415,580; 5,507,678; 6,048,209; 6,139,397; 6,149,490; 6,244,926; 6,413,142; PCT patent publications WO0044461 and WO02009834; and in the 1995 toy "Clever Cutie" by Irwin Toys, the disclosures of which are incorporated herein by reference.

SUMMARY

In one example a toy system may comprise a first body, at least one accessory having an activation feature, at least one mechanism adapted to alter the first body, and a first sensor adapted to sense the activation feature and to activate selectively the at least one first mechanism when the activation feature is sensed.

In another example, a toy system may include a body having first and second body elements that are adapted to be moved relative to each other, a drive element, and a sensor mounted relative to the body and adapted to be activated by a user. The second body element may also have a characteristic that is changeable. A first mechanism may be activated by the sensor and mounted relative to the first body element and the drive element. The first mechanism may have a plurality of operative states and may be adapted to move the drive element relative to the second body element, and to move the second body element relative to the first body element during movement of the drive element. A second mechanism may be mounted relative to the second body element and adapted to perform a function on the characteristic of the second body element in response to movement of the drive element. At least one of the body elements may have an inner chamber and an outwardly opening aperture. An extensible member may be supported relative to one of the body elements and selectively urged through the aperture by one of the mechanisms.

DETAILED DESCRIPTION

Figure 1:
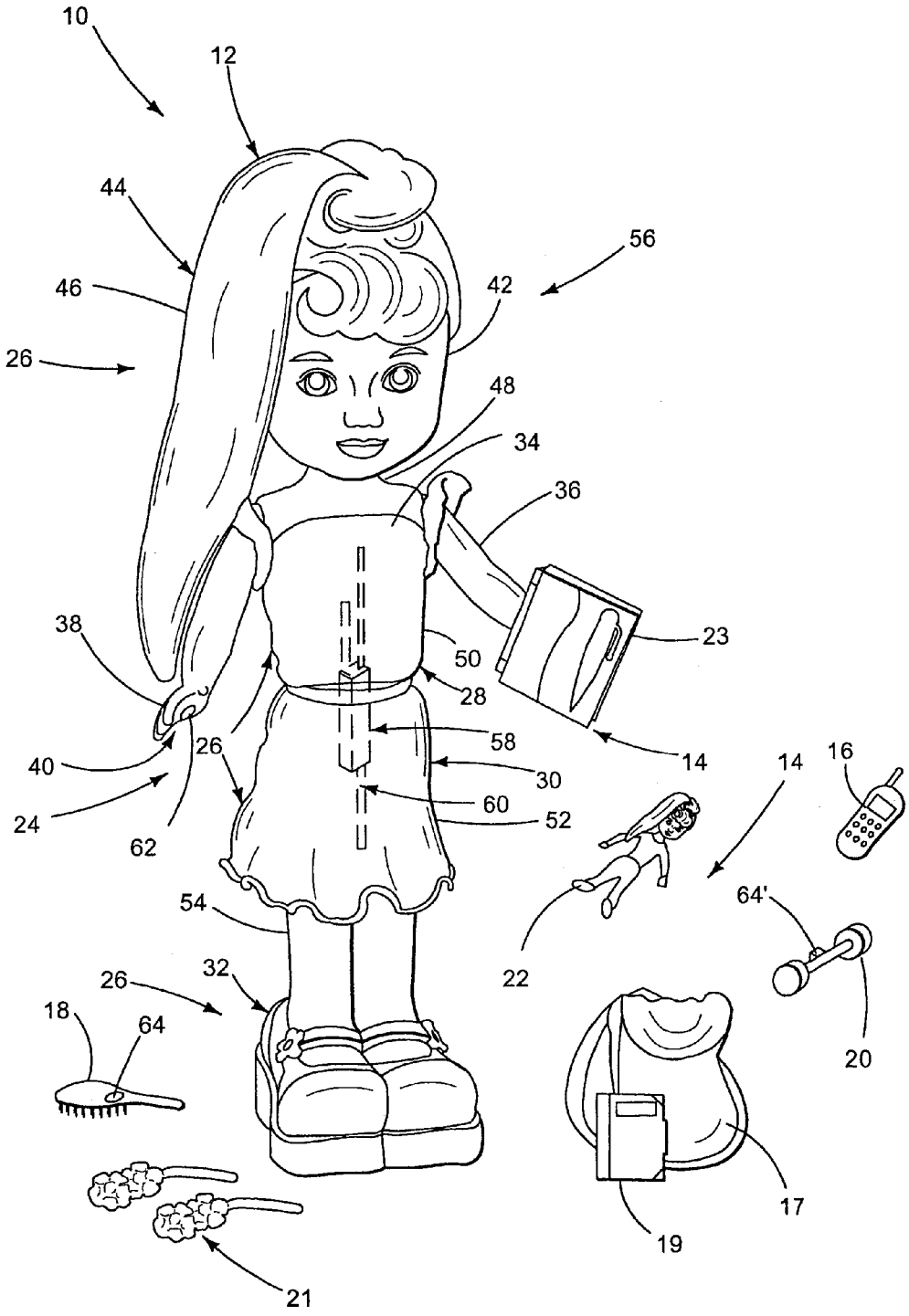
FIG. 1 shows an illustrative example of a toy system, including a first toy, a second toy, and accessories.

As shown in FIG. 1, a toy system 10 may include a first toy, or doll, 12, and at least one second toy 14, which may be a complete toy, similar to the first toy, or an accessory of the first toy, as shown. Accessories 14 may include, for example, a toy cellular phone 16, a purse 17, a hair brush 18, a toy radio 19, a baby rattle 20, hair barrettes 21, a doll 22, a notebook 23, or other items associated with toy 12. It should be appreciated that numerous possible embodiments exist for both the first and second toys, and those shown are intended as illustrative examples only. In this example, the first toy 12 has a body 24 comprised of several movable body elements 26. The present toy system simulates growth of a person, or animal, or other change by moving the body elements relative to one another. The toy may also exhibit growth of other common body features, such as hair, and change its speech and/or movement patterns to reflect a difference in maturity associated with the simulated growth. It should be appreciated that the toy may represent either real or fictitious persons or animals, or another form, such as a vehicle, building, robot, and the like.

In the illustrative example of body 24, body elements 26 include an upper torso 28, a middle torso 30, and a shoe assembly 32, as shown in FIG. 1. Upper torso 28 includes an upper chest 34 that supports arms 36 and hands 38. The hands, or other portions of body 24, may include one or more supports 40 that are adapted to support the various accessories. The upper torso also includes a head 42, having an extensible member 44 extending therefrom, such as hair 46, that is joined to the upper chest by a neck 48. Middle torso 30 in this example includes a lower chest 50 and upper legs 52. The upper legs connect to shoe assembly 32, which includes lower legs 54. Although the toy shown changes its height and hair length, as will be described, the body may change other characteristics instead of, or in addition to height and hair length, such as girth, facial features, coloring, movement, and speech, referred to collectively as characteristics 56. It should be appreciated that other characteristics may be used in place of, or in addition to hair 46, or the other body elements, such as a tongue or fingernails that may extend from, or retract into, the body, or depending on the structure of the toy, changing a dimension, moving an element, making a sound, or other characteristic.

For example, any number of these elements of body 24 are movable and actuated by body-altering assemblies 58, shown in dashed lines, such as by a variety of mechanisms 60, to move relative to one another. As has been mentioned, mechanisms 60, described in further detail below, may also alter other characteristics 56, such as changing hair length or spoken sounds.

Toy system 10 may include one or more sensors 62, such as a sensor 62 shown generally in FIG. 1 located on each hand 38 of the toy. The sensors may be located in any selected place. The sensor is provided to activate the toy in response to placement of an accessory or second toy 14 in engagement with sensor 62. Changes to the first toy may be determined by the type of accessory placed near, or in contact with, the first toy in a manner that activates the sensor. Therefore, a user may selectively activate a mechanism by choosing an accessory associated with the desired result. For example, placing a simulated cellular phone or hair brush in the hand of the toy may initiate growth of the toy and a change in the toy's speech and/or movement patterns. Alternatively, placing a baby rattle or doll in the toy's hand may cause the toy to revert to a more juvenile state by retracting or shrinking the body and initiating more child-like speech and/or movement patterns. The toy may exhibit several stages of growth based on a plurality of different accessories for increased variety and enjoyment with use of the toy system.

As previously mentioned, the second toy 14 of toy system 10 may be in the form of a complete toy with the same functionality of the first toy, rather than being merely an accessory. In such a system a second toy, representing for example a parent, beau, vehicle, or other object, may be placed or activated near the first toy 12 to activate sensor 62. The aspect of an accessory or second accessory or second toy that activates or triggers sensor 62 is referred to as an activation feature 64. The second toy 14 may itself have a sensor and associated mechanisms to alter the second toy, such as those described with respect to the first toy, or variations thereof such as elongating a second toy in the form of a vehicle to accommodate the larger size of the first toy in the form of a girl.

Figure 2:
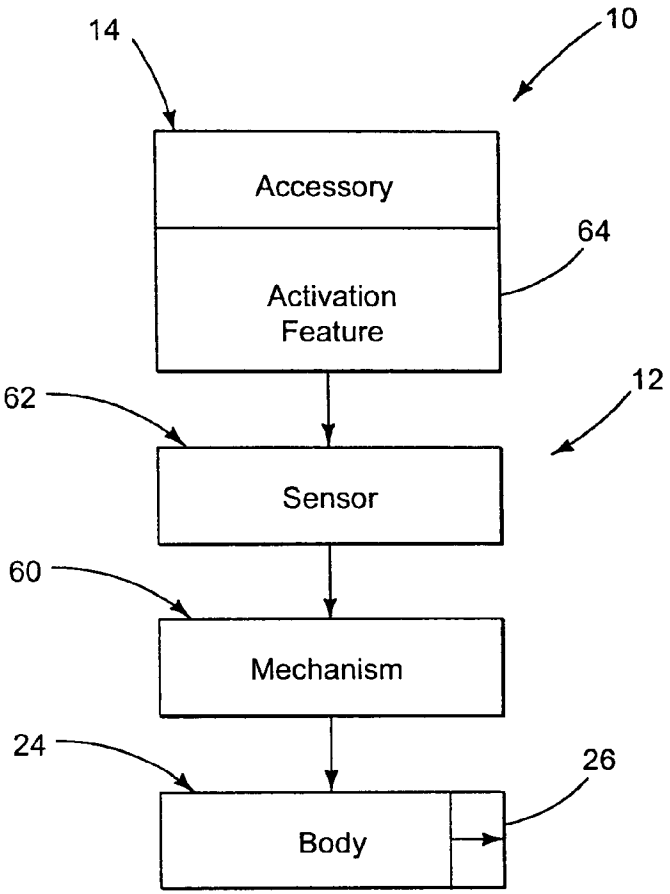
FIG. 2 is a diagram illustrating basic functionality of a toy system.

Sensors 62 may initiate changes, such as a change in the size of the toy. This may be accomplished through activation of one or more mechanisms 60, coupled to the sensor and adapted to alter the body when the sensor is activated. The toy may include a plurality of mechanisms 60, and each may have one or a plurality of operative states 66, not shown in FIG. 1, that may alter one or more characteristics of the associated body element 26, as shown generally in FIG. 2. A first sensor 62 may be adapted to sense the activation feature 64 of an accessory 14 and thereby to activate a mechanism 60. The mechanism may alter a body element 26 of a body 24.

Figure 3:
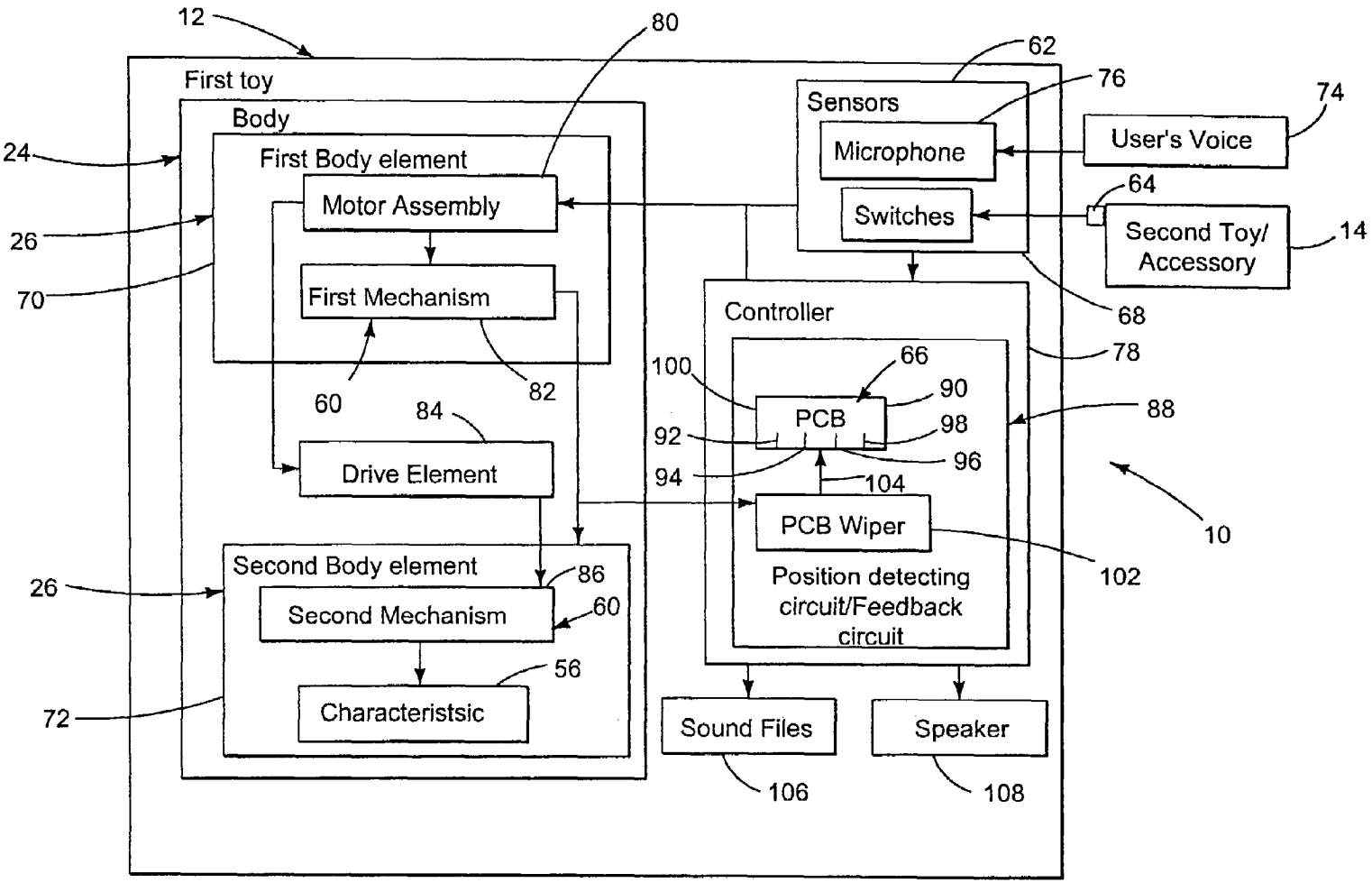
FIG. 3 is a diagram showing detailed functionality of a toy system.

A more detailed block diagram of a toy system is shown in FIG. 3. Toy system 10 may include a first toy 12 having a body 24 with a first body element 70 and a second body element 72. Mechanisms 60 of the first and second body elements may be activated by an activating element or action, such as a user's voice 74 or a second toy or accessory 14. The user's voice may activate a sensor 62 through a microphone 76, or the second toy may activate the sensors directly, as previously described.

Figure 4:
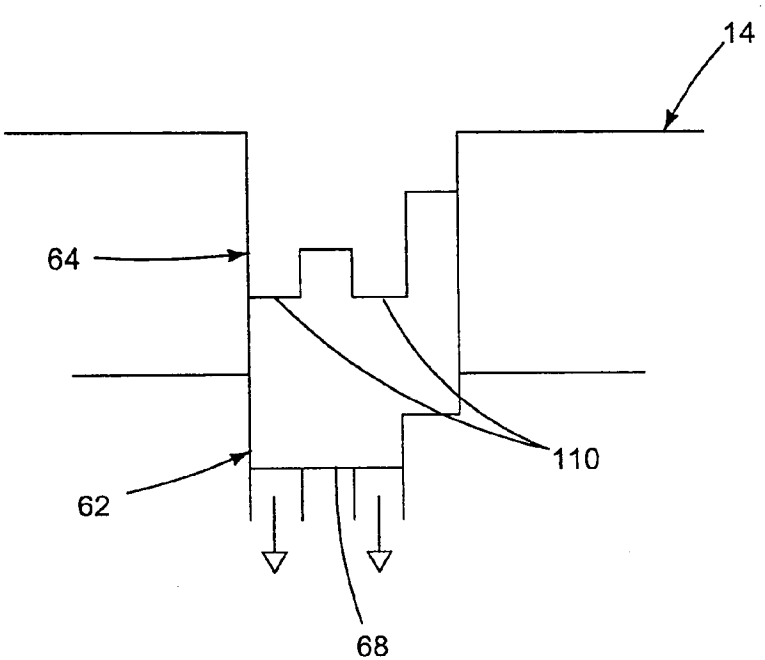
FIG. 4 shows an example of alignment of an accessory activation feature with a sensor.

Accessory 14 has an activation feature 64 that communicates to the sensor the nature or identity of the accessory. In the embodiment shown in FIG. 4, the accessory has a plurality of pins 108 configured to engage with various portions of sensor 62, shown in the form of switches 68. The configuration of the pins communicates the identity of the accessory to the switch. Different accessories may have different pin configurations and may be used to produce different responses or actions in toy 12. In this example, as is shown in FIG. 1, the switch is recessed in the support 40 on the toy, such as in either or both of the hands. It should be appreciated that sensor 62 may be mounted anywhere on or within the toy and any quantity of sensors of any suitable configuration or structure may be used. Optionally, wireless or wired forms of communicating a signal containing the nature or identity of the accessory to the sensor may be used, including, but not limited to, radio frequency, optical, or infrared signals. Thus, the sensor may be selectively activated by communication from an accessory, such as by contact with or transmission of signals from an accessory or second toy.

The sensor may signal a controller 78 that controls a motor assembly 80 mounted relative to the first body element. The motor assembly may perform various functions. One function may be the activation of a first mechanism 82 to move the second body element relative to the first body element. A second function may be to actuate a drive element 84. In this example, the drive element is used to drive a second mechanism 86, mounted relative to the second body element, which performs a function on a characteristic 56 of the second body element. Alternatively, in a simplified version of the toy, the sensors 62 may bypass the controller and activate the motor directly.

Continuing to refer to FIG. 3, controller 78 may also include a position detecting circuit, or feedback circuit, 88 so that the controller is continuously, or intermittently, apprised of the status of the toy, including the position of the body elements and/or characteristics that are being altered. The position detecting circuit may include a device for detecting the relative position of two body elements. For instance, a printed circuit board (PCB) 90 may have several regions divided into conductive pads 92, 94, 96, and 98. A PCB wiper 102, having at least one wiper contact 104, may contact one of the conductive pads depending on the structure of the pads and contacts. The PCB and PCB wiper are attached directly or indirectly to different moving parts, such as body elements. The relative position of the PCB and PCB wiper thereby corresponds to a particular configuration of the toy. In this example, the PCB wiper tracks the movement of the second body element relative to the first body element. Thus, several stages of relative movement ("growth") may be identified by contact of the PCB wiper with each respective conductive pad 92, 94, 96, and 98 while the PCB wiper moves across the PCB.

The controller may also access sound files 106 and emit them through a speaker 108. Thus, phrases uttered by the toy may be varied as growth, or configuration, of the toy varies. The electronics included in the controller may use sensors that monitor switches, radio frequency identification circuits, or other electrical sensors as disclosed in some of the incorporated prior art, any of which may be used to respond to sensors 62 to produce growing or shrinking movement of the body of the toy, and corresponding changes in speech and associated behavior. The controller may include a microcomputer with a processor or microprocessor and memory, or other logic unit adapted to perform logic operations, whether stored in hardware, firmware or software. It may be a single unit or a combination of units.

It will be understood then that the toy may portray an apparent "age" based on the position of the body elements. The toy may "act" more mature, when the body elements are extended, by accessing sound files corresponding to mature behavior. Similarly, the toy may act less mature, when the body elements are retracted, by accessing sound files corresponding to less mature behavior. It should be appreciated that the sound files need not be associated with age, but may include any sounds appropriate to the type of toy, such as that of animals, vehicles, or other structures as previously mentioned.

Figure 5:
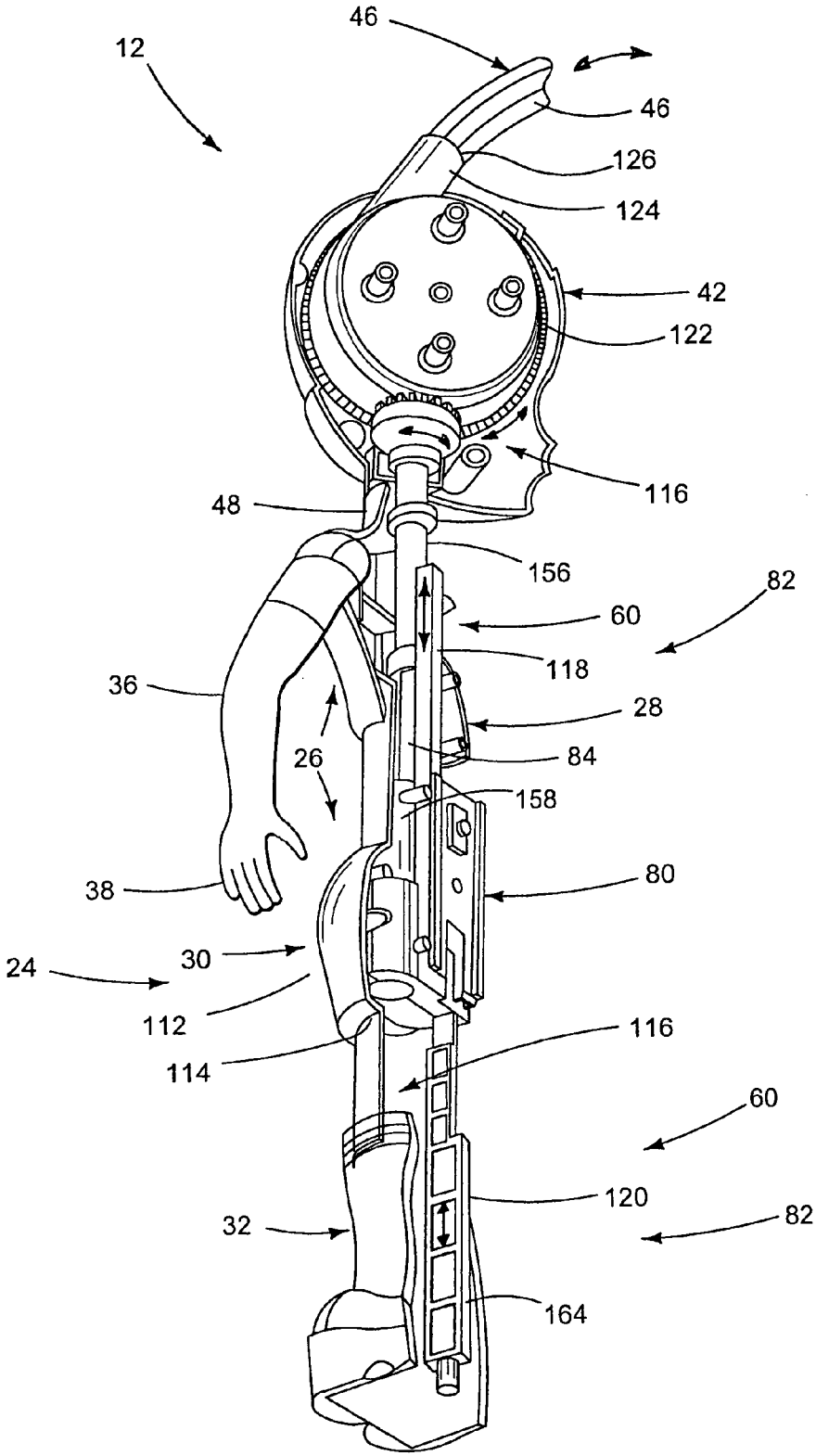
FIG. 5 is an illustrative example of body altering mechanisms within a first toy, including a hair mechanism, a torso mechanism, a leg mechanism, and a motor assembly that drives the mechanisms.

FIGS. 5-14 illustrate a specific example of a toy system 10. FIG. 5, in particular, provides a view of toy 12 with a portion of the outer body elements removed. In general, the body 24 of the first toy 12 has an outer surface 112 and an inner surface 114 thus forming inner chambers 116. In the case of telescoping elements, the outer surface of one element may slide adjacent the inner surface of another element. Optionally, the body may have a resiliently deformable exterior connecting the body elements.

In the illustrative example shown in FIG. 5, mechanisms 60 include a torso mechanism 118, a leg mechanism 120, and a hair mechanism 122. The torso mechanism moves upper torso 28 relative to middle torso 30 while the leg mechanism moves shoe assembly 32 relative to the middle torso. Similarly, the hair 44 mechanism moves the hair relative to the body element to which it is mounted, namely the head 42. Either of the torso mechanism or the leg mechanism may function as a first mechanism 82 that imparts a force to move a body element. A drive element 84 drives a second mechanism 86, such as hair mechanism 122. The hair mechanism may include a hair bundle tube 124 having an outwardly opening aperture 126, through which the hair 46 may pass to change a characteristic of the body.

Figure 6:
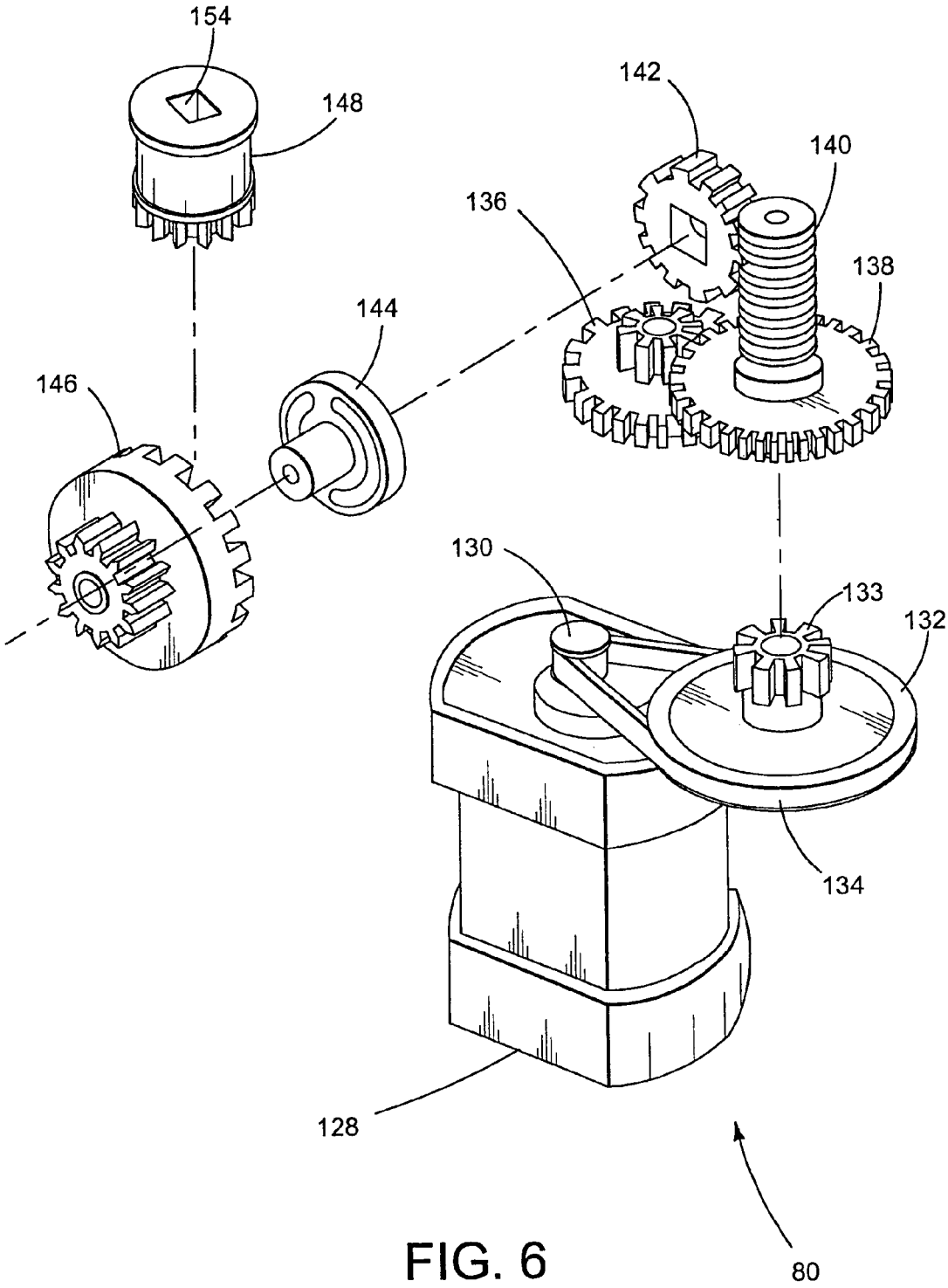
FIG. 6 is a detailed view of the motor assembly of FIG. 5 including a motor and gears.

A motor assembly 80 contained within a housing 158 is provided to drive a plurality of gears that actuate each of the mechanisms 60. As illustrated in FIG. 6, motor assembly 80 includes a motor 128 that drives a small pulley 130. Small pulley 130 is connected to a large pulley 132 by a belt 134. Large pulley 132 has a shaft with a main drive gear 133 to drive the plurality of gears.

The main drive gear 133 drives the larger gear of a compound gear 136. The smaller gear of compound gear 136 drives a first gear 138 that in turn rotates a worm gear 140. Worm gear 140 rotates a second gear 142. Attached to the second gear is a clutch plate 144 that drives a crown compound gear 146. Finally, a third gear 148 is driven by the crown compound gear to rotate with an axis of rotation normal to that of the crown compound gear. It should be appreciated that such a plurality of gears is intended to be illustrative, rather than limiting, as numerous methods of transferring power from motor 128 to mechanisms 60 may be employed.

Figure 7:
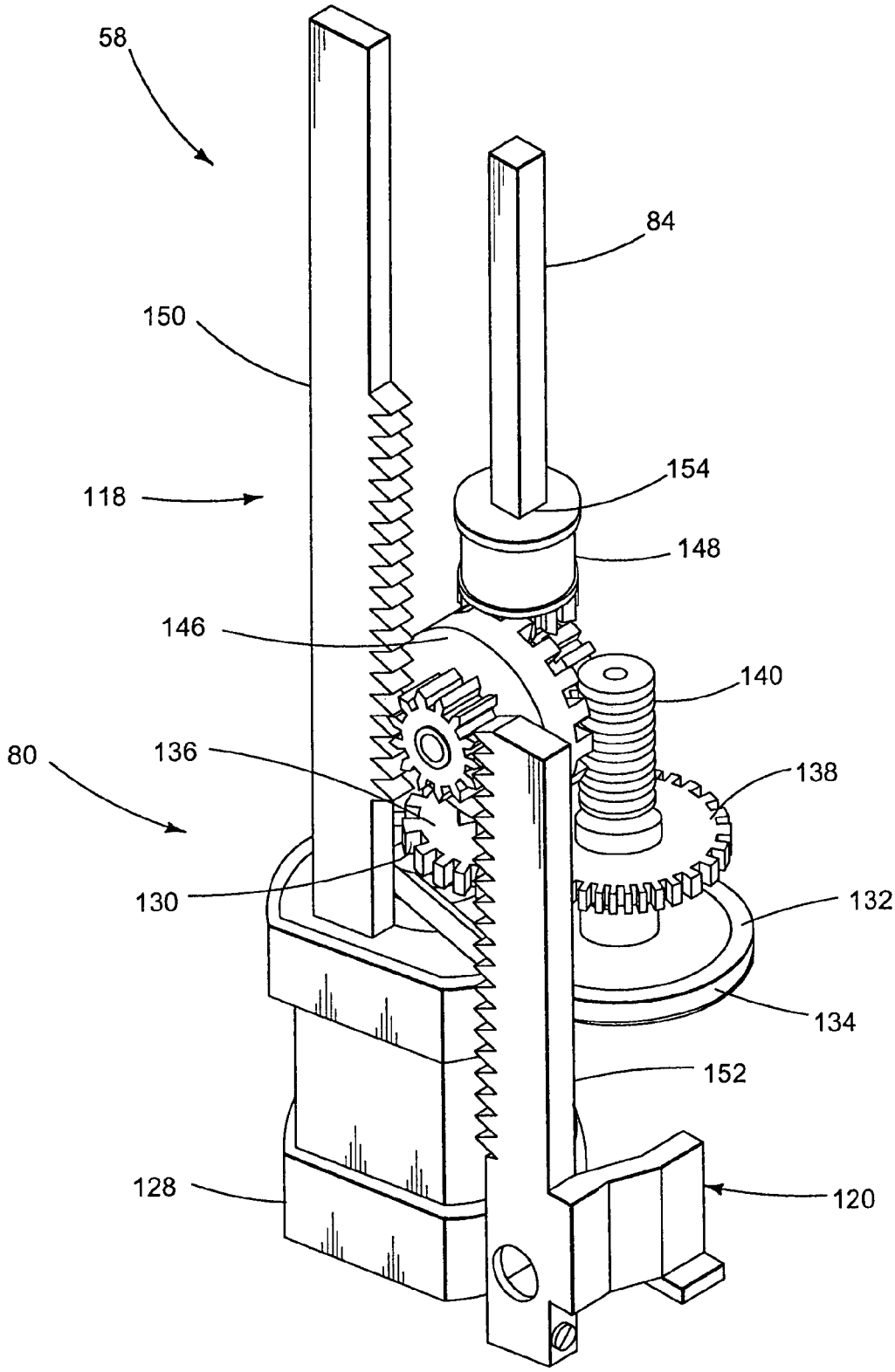
FIG. 7 illustrates the combination of a torso rack gear, a leg rack gear, and a neck shaft with the motor assembly of FIG. 6.

As shown in FIG. 7, once the motor assembly is activated, torso mechanism 118 is driven by a torso rack gear 150. Similarly, the leg rack gear 152 drives the leg mechanism. Both of these rack gears are driven in opposite directions by rotation of a small gear of compound gear 146. Preferably, these dual opposed rack gears are slidably supported in the middle torso, and are driven from a single pinion gear, such as crown compound gear 146, in opposite directions to push the upper torso and the shoe assembly away from the middle torso in equal amounts. Additionally, third gear 148 has an aperture 154 into which a neck shaft 156 engages. The neck shaft is used to drive element 84 of hair mechanism 122 as will later be described.

Figure 8:
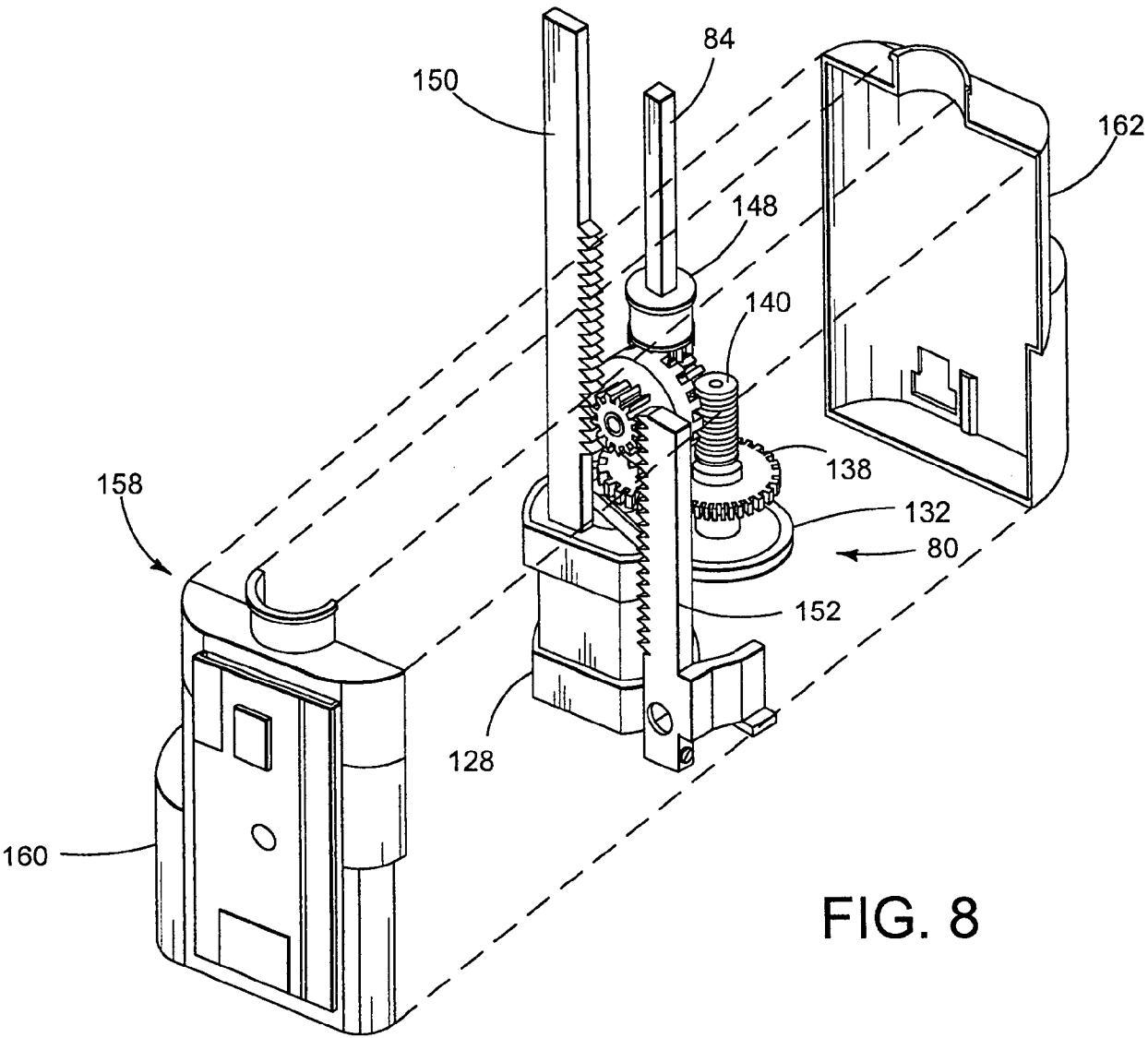
FIG. 8 shows an exploded view of a housing, motor assembly, and associated drive elements.

FIG. 8 illustrates a housing 158 that encompasses the motor assembly. The housing includes a front portion 160 and a back portion 162.

Figure 9:
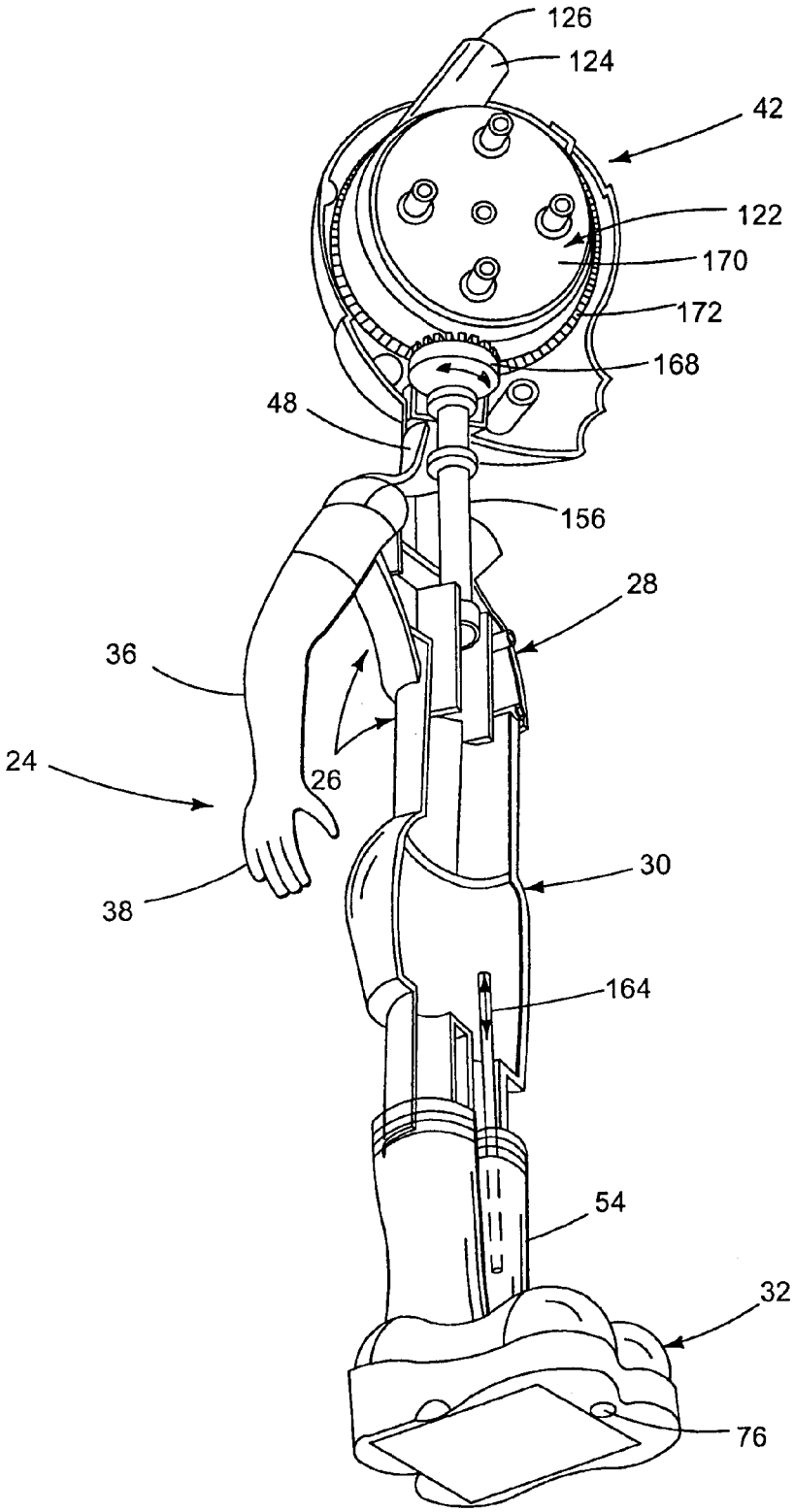
FIG. 9 shows further details of the doll body, leg and hair mechanisms without the housing and associated driven elements.

Moving on to FIG. 9, a leg shaft 164, connected to leg rack gear 152, is provided to extend the motion of the leg mechanism into the shoe assembly. The distal end of the leg shaft is anchored to the interior of the shoe assembly.

Figure 10:
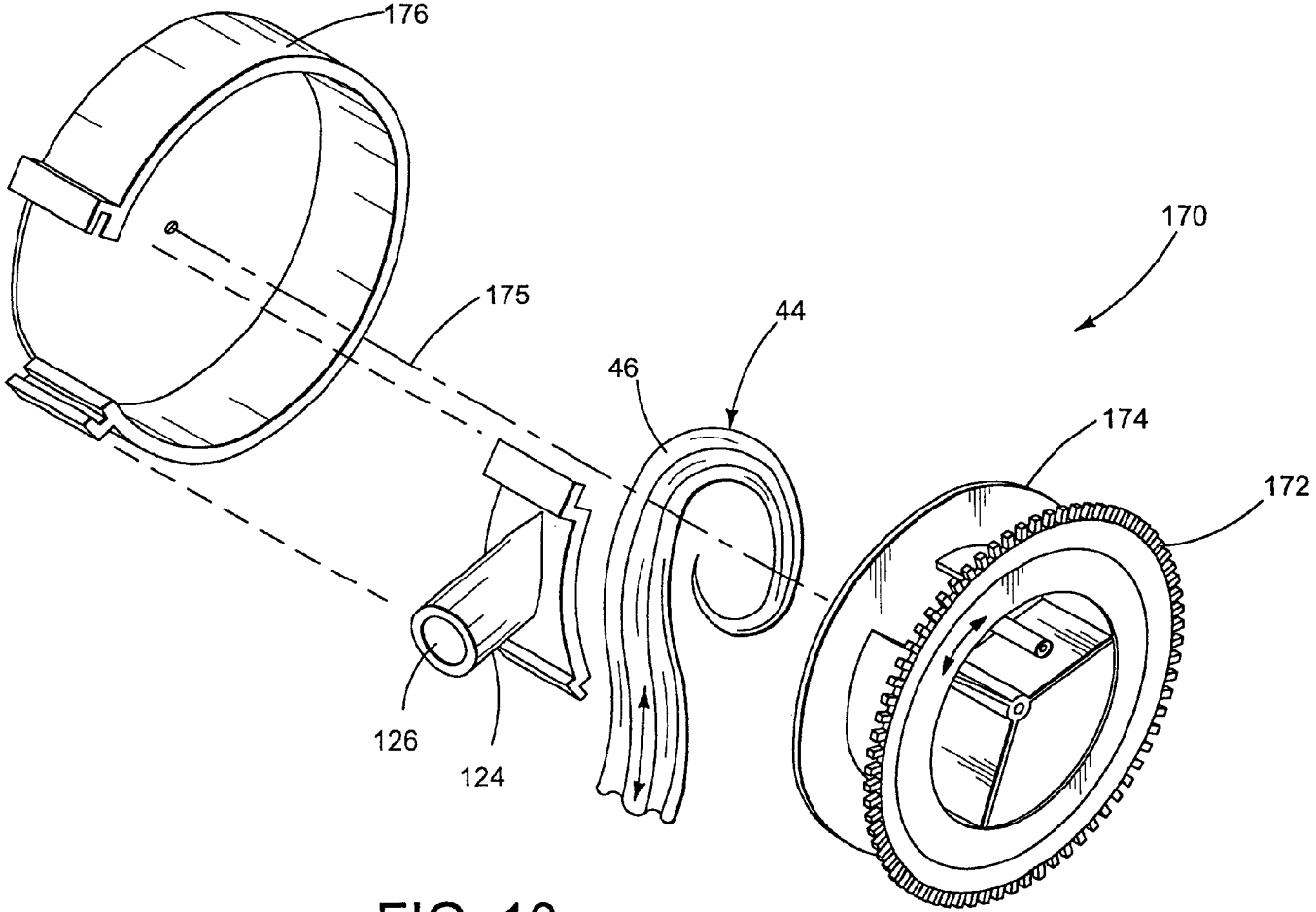
FIG. 10 is an exploded view of the hair mechanism, including a hair retainer assembly having a hair retainer, a hair retainer cover, a hair bundle tube, and a length of hair.

Referring to hair mechanism 122 and FIG. 10, the neck shaft 156, also referred to as a drive element 84, rotates a neck crown gear 168 to engage a hair retainer assembly 170. The retainer assembly includes a hair retainer 174 and a hair cover 176. Hair retainer 174 is shaped like a spool with retainer teeth 172 along one edge. The retainer assembly is mounted to rotate about an axis 175, and retainer teeth 174 mesh with the teeth in the neck crown gear. Hair 46, as a form of an extensible member 44, is wound and unwound on the hair retainer as the hair retainer is rotated in reverse directions. The rotation of the hair retainer urges the hair through aperture 126 of hair bundle tube 124.

As motor assembly 80 operates, hair mechanism 122 operates along with torso mechanism 118 and leg mechanism 120. Thus, the amount of exposed hair corresponds to the length of the torso and legs. Changing the hair length to match changes in the height of the toy is only one example of how a second mechanism may alter a second characteristic (hair length) in conjunction with movement, or position, of a body element due to a first mechanism. Alternatively, this characteristic may be the length or position of a tongue or finger nails as previously mentioned. Additionally, the characteristic changes may correspond to changes to hair, eye, or skin color, or expulsion of simulated tears, blood or mucus to make the toy more interesting to children of either or both genders. The motion imparted by any of these mechanisms may be used to produce other changes. For instance motion imparted to a region of the head by the neck shaft may also drive changes to other facial features, such as moving a mouth, blinking eyes, or wiggling ears.

Figure 13:
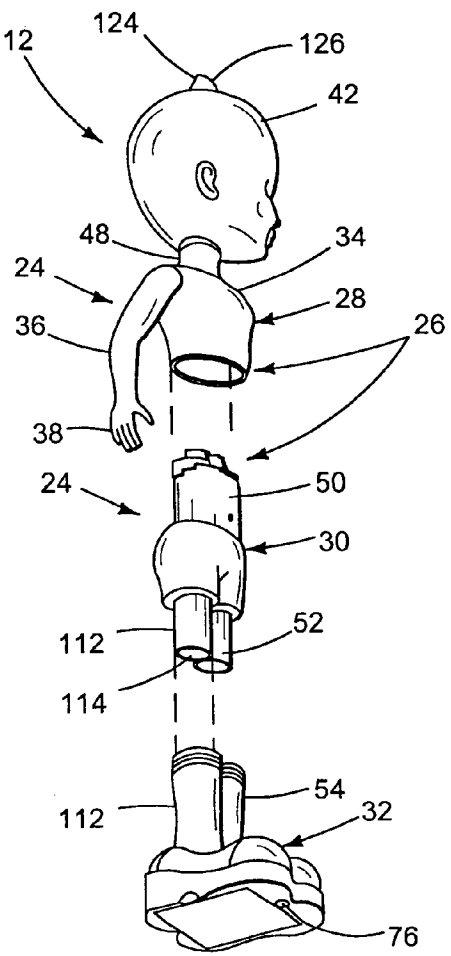
FIG. 13 is an exploded view of the body elements of the toy.
Figure 12:
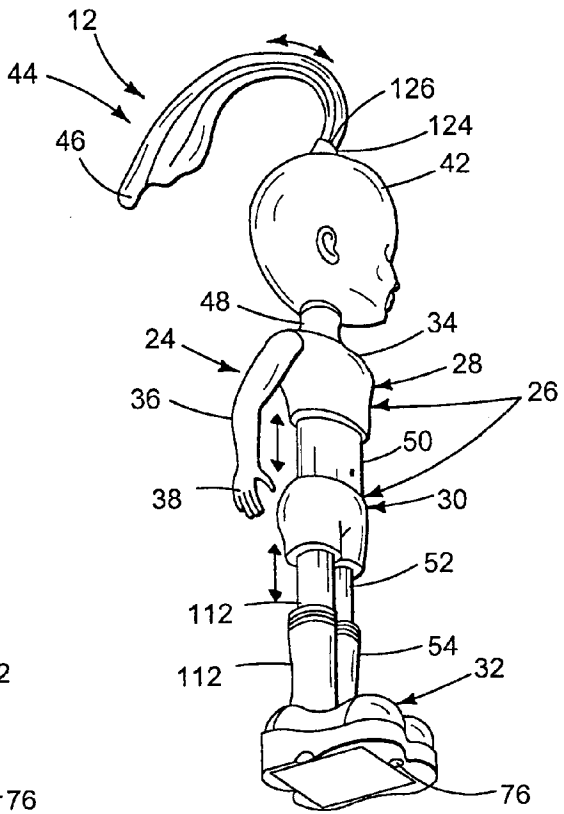
FIG. 12 is an isometric view of the toy showing body elements in extended positions.
Figure 11:
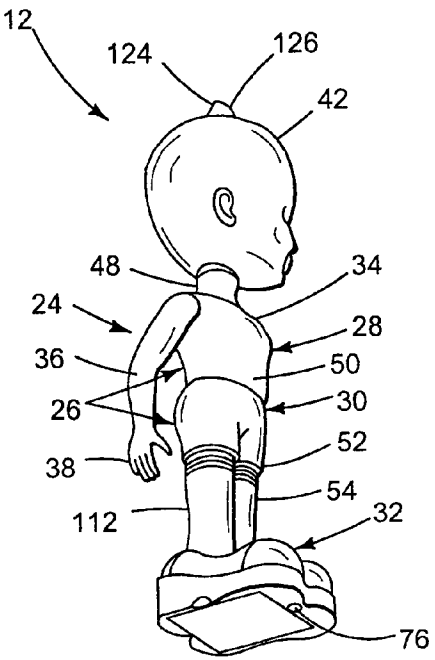
FIG. 11 is an isometric view of the toy showing body elements including an upper torso, a middle torso, and a shoe assembly in retracted positions.

As illustrated in FIG. 11-13, upper torso 28, middle torso 30, and shoe assembly 32 are forms of telescoping body elements 26. Thus, the outer surfaces of the middle torso move into and out of inner chambers formed by the inner surfaces of the upper torso and the shoe assembly, thereby simulating changes in height. A variety of configurations are therefore possible to increase the enjoyment available to a user.

Figure 14:
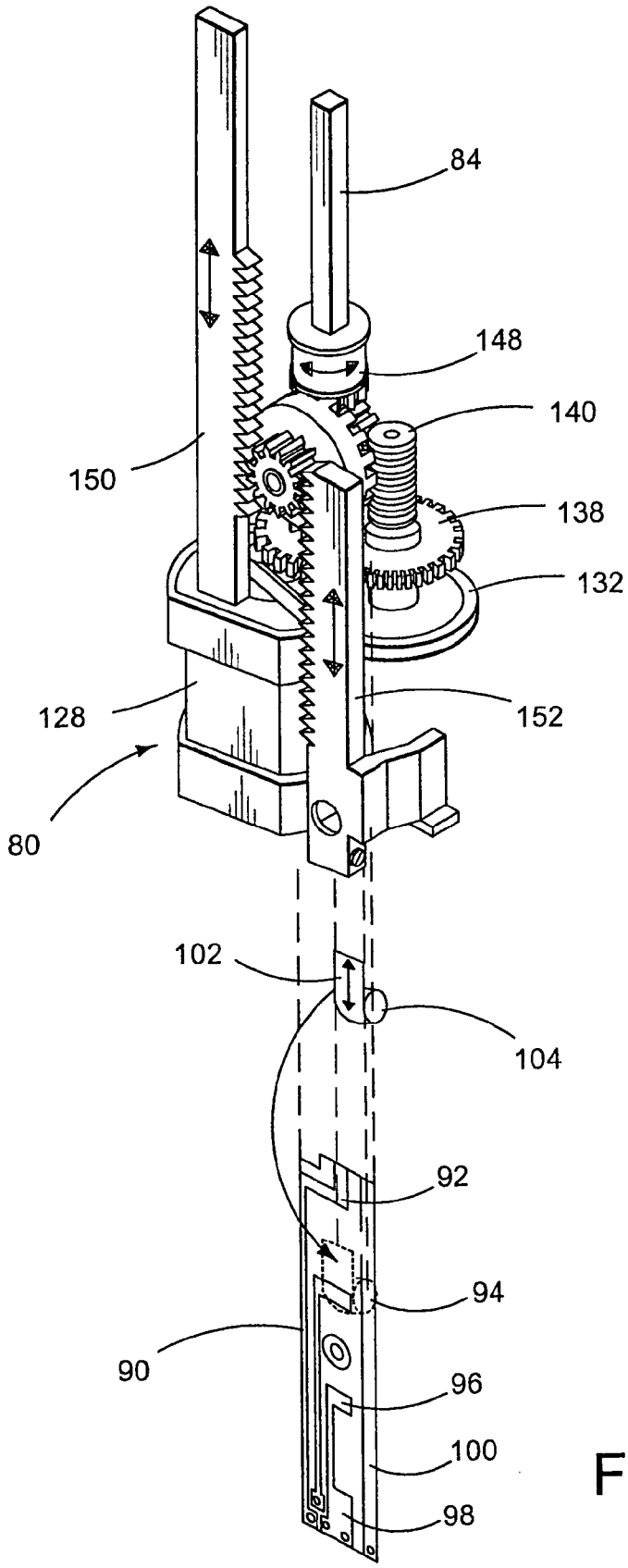
FIG. 14 illustrates the motor assembly and an exploded view of a printed circuit board (PCB) and a PCB wiper.

FIG. 14 illustrates the structure and placement of PCB 90 and PCB wiper 102 as part of a position detecting circuit 88. PCB 90 includes a planar array of electrically separated position-indicating conductive pads 92, 94, 96 and 98 positioned at spaced locations along a reference conductor 100. Wiper 102 is conductive and forms a bridge between conductor 100 and any of pads 92, 94, 96 and 98 with which it is aligned. In the example shown, the PCB is mounted relative to motor housing 158, and thereby to middle torso 30. The PCB wiper is mounted relative to leg rack gear 152. The wiper thus moves across the various conductive pads 92, 94, 96 and 98 of the PCB as the leg rack gear moves away from or toward the motor assembly. The position detecting circuit in controller 78 is connected to the conductive traces on the PCB associated with pads 92, 94, 96 and 98 and conductor 100. The circuits associated with each of the pads are normally open circuits. When the wiper contacts a pad, the circuit is closed and a function associated with that pad is thereby activated.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where any claim recites "a" or "a first" element or the equivalent thereof, such claim should be understood to include incorporation of one or more such elements, neither requiring nor excluding two or more such elements.

Inventions embodied in various combinations and subcombinations of features, functions, elements, and/or properties may be claimed through presentation of new claims in a related application. Such new claims, whether they are directed to a different invention or directed to the same invention, whether different, broader, narrower or equal in scope to the original claims, are also regarded as included within the subject matter of the inventions of the present disclosure.

We claim:

1. A toy system comprising:

a plurality of different ones of at least one accessory having an activation feature; and a doll body including:

a first body element and a second body element;

at least one first mechanism adapted to simulate growth by translating one of the first body element and the second body element relative to the other of the first and second body elements, thereby elongating a dimension of the doll body;

a first sensor adapted to sense the activation feature and to activate selectively the at least one first mechanism when the activation feature is sensed, the sensor being mounted to the doll body and the doll body having a support adapted to receive the at least one accessory, the first sensor being adapted to detect the different accessories; and a controller coupled to the mechanism assembly and to the sensor, and adapted to control operation of the mechanism assembly differently when the sensor detects different accessories.

2. The toy system of claim 1, wherein the first mechanism is driven by a motor assembly that is controlled by the sensor.

3. The toy system of claim 2, further comprising a controller responsive to the relative position of the first and second body elements and adapted to control operation of the motor assembly in a manner corresponding to the position of the first body element relative to the second body element.

4. The toy system of claim 1, wherein the at least one accessory forms a second body and includes at least one second mechanism adapted to alter the second body.

5. The toy system of claim 4, wherein the accessory has a second sensor adapted to sense activation of the at least one first mechanism and to activate the at least one second mechanism when the activation of the at least one first mechanism is sensed.

6. The toy system of claim 1, wherein the body has at least one chamber having an outwardly opening aperture and one of the first and second body elements includes an extensible member supported in the chamber and adapted to be urged through the aperture by the at least one first mechanism.

7. A toy comprising:

a body including first and second body elements, at least one of the first and second body elements representing a torso segment, the first and second body elements configured to slide relative to each other to alter a dimension of the body and the second body element having a characteristic that is changeable;

a drive element;

a sensor mounted relative to the body and adapted to be activated by a user;

at least one sound corresponding to a relative position of the first and second body elements and configured to be emitted when the sensor is activated;

a first mechanism activated by the sensor when the sensor is activated and mounted relative to the first body element and the drive element, the first mechanism being adapted to move the drive element relative to the second body element, and to move the second body element relative to the first body element during movement of the drive element;

a second mechanism mounted relative to the second body element, adapted to perform a function on the characteristic of the second body element in response to movement of the drive element; and an accessory, wherein the sensor is activated by manipulation of the accessory relative to the sensor, wherein the body has a support adapted to support the accessory and the sensor is activated by placement of the accessory in the support.

8. The toy of claim 7, wherein the body has at least one chamber having an outwardly opening aperture and an extensible member supported in the chamber and adapted to move through the aperture.

9. The toy of claim 8, wherein the second mechanism is adapted to urge the extensible member through the aperture.

10. A toy system comprising:

a body having a plurality of body elements, including at least one first body element having an inner chamber and an outwardly extending aperture and a second body element;

an extensible member supported by a spool relative to the first body element;

a body-altering assembly adapted to urge selectively the extensible member through the aperture while rotating a portion of the extensible member, the body-altering assembly including a motor assembly controlled by the sensor and adapted to move the first body element relative to the second body element;

a sensor mounted relative to the body, coupled to the body-altering assembly, and adapted to be activated by a user, the body-altering assembly being activated when the sensor is activated by a user; and a controller responsive to the relative position of the first and second body elements and adapted to control operation of the motor assembly in a manner corresponding to the position of the first body element relative to the second body element.

11. The toy system of claim 10, further comprising an accessory adapted to be manipulated in a given manner by a user, wherein the sensor is activated when the accessory is manipulated in the given manner.

12. The toy system of claim 11, further comprising a plurality of different ones of the accessories, the sensor being adapted to detect the different accessories, the toy system further comprising a controller coupled to the body-altering assembly and to the sensor, and adapted to control operation of the body-altering assembly differently when the sensor detects different accessories.

13. A toy comprising:

a body including first and second body elements, the first and second body elements being moveable relative to each other and the second body element having a characteristic that is changeable;

a drive element;

a plurality of different accessories;

a sensor mounted relative to the body and adapted to detect the plurality of different accessories;

a first mechanism activated by the sensor when the sensor is activated and mounted relative to the first body element and the drive element, the first mechanism being adapted to move the drive element relative to the second body, and to move the second body element relative to the first body element during movement of the drive element;

a controller coupled to the first mechanism and to the sensor, and adapted to control operation of the first mechanism differently when the sensor detects the different accessories; and a second mechanism mounted relative to the second body element, adapted to change the characteristic of the second body element in response to movement of the drive element.

* * * * *